US006254272B1

(12) United States Patent
Dilick

(10) Patent No.: US 6,254,272 B1
(45) Date of Patent: Jul. 3, 2001

(54) METHOD AND APPARATUS FOR EXTENDING THE LIFE OF AN X-RAY TUBE

(76) Inventor: Maurice D. Dilick, Madison, TN (US)

( * ) Notice: Subject to any disclaimer, the term of this patent is extended or adjusted under 35 U.S.C. 154(b) by 0 days.

(21) Appl. No.: 09/244,729

(22) Filed: Feb. 5, 1999

(51) Int. Cl.[7] ..... H01J 35/10
(52) U.S. Cl. ..... 378/200; 378/199; 378/130
(58) Field of Search ..... 378/199, 200, 378/130

(56) References Cited

U.S. PATENT DOCUMENTS

| | | | |
|---|---|---|---|
| 1,987,790 | 1/1935 | Mutscheller . | |
| 4,115,697 | 9/1978 | Hounsfield et al. | 378/198 |
| 4,238,682 | 12/1980 | Vratny . | |
| 4,402,085 | 8/1983 | Distler et al. . | |
| 4,405,876 | 9/1983 | Iversen . | |
| 4,455,504 | 6/1984 | Iversen . | |
| 4,622,687 | 11/1986 | Whitaker et al. . | |
| 4,688,239 | 8/1987 | Schaffner et al. . | |
| 4,698,983 | 10/1987 | Hechavarria . | |
| 4,767,961 | 8/1988 | Koller et al. . | |
| 4,841,557 | 6/1989 | Habberrecker et al. . | |
| 4,865,743 | 9/1989 | Kroener . | |
| 4,918,714 | 4/1990 | Adamski et al. . | |
| 4,928,296 | 5/1990 | Kadambi . | |
| 4,938,315 | 7/1990 | Ohta et al. . | |
| 4,949,369 | 8/1990 | Bittl . | |
| 5,012,505 | 4/1991 | Zupancic et al. . | |
| 5,074,379 | 12/1991 | Batrice . | |
| 5,083,307 | 1/1992 | Meinel et al. . | |
| 5,086,449 | 2/1992 | Furbee et al. | 378/200 |
| 5,099,955 | 3/1992 | Mangen et al. . | |
| 5,101,641 | 4/1992 | Van Steenburgh, Jr. . | |
| 5,168,720 | 12/1992 | Keltner . | |
| 5,222,118 | 6/1993 | Gerth | 378/200 |
| 5,242,032 | 9/1993 | Prestwood et al. . | |
| 5,313,512 | 5/1994 | Tanaka . | |
| 5,372,219 | 12/1994 | Peralta . | |
| 5,440,608 | 8/1995 | Peralta et al. | 378/200 |
| 5,596,622 | 1/1997 | Peralta et al. | 378/200 |
| 5,732,123 | 3/1998 | Peralta et al. | 378/200 |
| 6,074,092 * | 6/2000 | Andrews | 378/200 |
| 6,123,456 * | 9/2000 | Lyons | 378/200 |

FOREIGN PATENT DOCUMENTS

| | | |
|---|---|---|
| 08236048 | 9/1996 | (JP) . |
| WO92/06758 | 4/1992 | (WO) . |
| WO95/10345 | 4/1995 | (WO) . |

OTHER PUBLICATIONS

Applicant's declaration under 37 CFR 1.132 (not admitted to be prior art, except where indicated.)

"Mounting Instruments for X–Ray Tube Assembly", documentation Section B and C by Phillips Medizin Systeme GmbH, Hamburg Germany, Nov. 1983,

* cited by examiner

*Primary Examiner*—Robert H. Kim
*Assistant Examiner*—Drew A. Dunn
(74) *Attorney, Agent, or Firm*—John E. Hyatt

(57) ABSTRACT

The present invention teaches methods and apparatus for extending the life of an x-ray tube. An x-ray tube typically contains an insert for generating x-rays. The insert is housed in a housing wherein an insulating fluid circulates around the insert in the housing to provide thermal and electrical insulation. The present invention includes methods and apparatus for removing water from insulating oil. One embodiment of the invention includes a processor containing a coalescing element for removing water as a vapor from the oil. Other embodiments include methods and devices for drying the interior of the housing. Another embodiment of the invention includes a kit containing a processor having a coalescing element for removing water from the insulating oil. The portable kit allows the invention to be practiced on x-ray tubes maintained in gantry supports of x-ray machines, such as CT scanners.

79 Claims, 9 Drawing Sheets

METHOD AND APPARATUS FOR EXTENDING THE LIFE OF AN X-RAY TUBE

BACKGROUND OF THE INVENTION

The present invention relates to methods and devices for extending the life of an x-ray tube. Typically x-ray tubes are mounted inside a lead shielded radiation enclosure called a housing or casing. The housing is attachable to the x-ray machine, typically a CT, fluoroscopic, or rad machine. The housing is filled with a fluid of synthetic or petroleum derivative, generally referred to as insulating oil. The insulating oil acts to thermally and electrically insulate the tube. Heat is generally removed to air through fluid to water or fluid to water cooled air transfer.

All such fluids, are damaged, from four major contributors: (1) heat; (2) radiation; (3) high voltage arcing; and (4) corona discharge.

This heating oil is sold by two primary standards: (1) ASTM 877 for unprocessed oil; and (2) ASTM 1816 for processed oil. Insulating oil consists of perhaps 3500 separate hydrocarbons. The hydrocarbons having varying carbon bond lengths with many separate bonded molecules and ions, such as hydrogen, oxygen, hydroxyls, and many others.

For most x-ray products, the end of life is primarily predicated by an arcing process. Failure is accentuated by deposition on the glass or metal window of the insert. Deposition on the high voltage hold off leads to collapse in the insert itself, leading to subsequent deterioration of rotor function. The arcing while starting out infrequently, increases in frequency as the oil deteriorates. As the arcing increases the oil deteriorates more rapidly which, in turn, leads to more arcing.

It is commonly thought that the greases and waxes produced during the life of an x-ray tube are deleterious to the insulating oil, i.e. damaging. Such is the motivation behind U.S. Pat. No. 5,440,608 entitled "Method And System For Extending The Service Life Of An X-Ray Tube" by Peralta, et al. The method taught in Pat. '608, and subsequent patents by Peralta, U.S. Pat. Nos. 5,596,622 and 5,732,123. U.S. Pat. Nos. 5,440,608; 5,732,123; and 5,596,622 are collectively referred to herein as PERALTA. PERALTA describes methods and apparatus for removing the old oil and replacing it with new oil, and methods for filtering the greases and waxes produced during the life of an x-ray tube. As PERALTA points out, the financial risks involved in when working with x-ray tubes and CT scanners is substantial. Tubes are very delicate in some respects and require great care when repairing them.

One problem encountered in the past has been the removal of bubbles which has come out of solution, or removal of those introduced into the system when oil has been replaced. For Siemens and Phillips manufactured tubes it has been quite common for many years to remove bubbles by replacing the oil. Circa 1984, General Electric introduced quick-disconnects into the hydraulic system, i.e. quick-disconnects in-line between the heat exchanger and the x-ray tube housing. This facilitated the removal of bubbles from the system. Since approximately 1985, this inventor has had occasion to open the hoses between the heat exchanger and the x-ray tube to remove bubbles, or replace oil, or both. PERALTA describes these well known techniques.

This inventor believes the greases and waxes are not as damaging as is commonly believed. In fact, the addition of new oil, as taught by Peralta, is contrary to preferred embodiments of the present invention.

SUMMARY OF THE INVENTION

The present invention relates to methods and apparatus for extending the life of an x-ray tube. One embodiment of the present invention includes a method of extending the life of an x-ray tube having a housing and an insert located therein for producing x-rays. The method comprises the steps of providing the x-ray tube with an insulating oil in the housing; and processing the insulating oil to remove deleterious gases from the oil.

In a preferred embodiment the step of processing the oil to remove deleterious gases from the oil comprises removing water from the oil. The method also includes drying the housing. In one embodiment this is accomplished by circulating insulating oil which has been dried through the housing to absorb water in the housing and drying, or withdrawing, water from the oil.

Another embodiment of the present invention includes an x-ray tube oil processor for extending the life of an x-ray tube. This is accomplished by processing the insulating oil for the x-ray tube. The x-ray tube oil processor includes a processing chamber having an oil inlet, an oil outlet, and a gas outlet. Preferably a coalescing element is positioned in the processing chamber. The coalescing element has a first end in fluid communication with the oil inlet.

Generally a vacuum source is placed in fluid communication with the gas outlet to evacuate the processing chamber. An oil inlet hose and an oil outlet hose are respectively connected in fluid communication to the oil inlet and the oil outlet of the processing chamber. Oil then enters the oil inlet hose, passes through the coalescing element which removes gases, in particular water as a vapor, from the oil, and the oil then exits the oil outlet hose.

Another embodiment of the present invention includes an x-ray tube processing kit for processing oil in an x-ray tube. The kit is important in the present invention because this allows the x-ray tube processor to be readily portable to a field location in which the x-ray tube is mounted on a gantry of an x-ray machine or CT scanner, and the like. The kit generally comprises a processing chamber containing a coalescent filter; a plurality of fluid hoses adapted to connect to the processing chamber. Preferably the kit also includes an oil pump adapter to connect to one of the plurality of fluid hoses; and a vacuum pump adapted to connect to the processing chamber.

It is desirable to process the oil while the x-ray tube is mounted in the gantry to avoid the time, expense and potential risk of dismounting the x-ray tube, remounting the x-ray tube, calibrating the x-ray tube. It is also desirable because it avoids extended down time of the x-ray machine.

One object of the present invention is to provide a means for extending the life of an x-ray tube. Another object of the present invention is to reduce healthcare costs. A further object of the invention is to encourage manufacturers to develop longer lasting tubes at lower costs.

One object of the present invention is to provide a device for drying the housing of an x-ray tube. Another object of the present invention is to provide a device for removing water from the insulating oil of an x-ray tube.

Another object of the present invention is to provide a device for improving the performance of x-ray tubes.

Another object of the present invention is to provide a device for resurrecting "failed tubes."

Another object is to teach a preventive maintenance program for extending the life of, and improving the performance of, an x-ray tube. A further objective is to provide a device for performing the preventive maintenance program.

Another object of the present invention is to provide a device for drying insulating oil of an x-ray tube.

Another object of the present invention is to provide a device for taking gases out of a solution wherein the gases are in the insulating oil of an x-ray tube.

A further object of the present invention is to out-gas deleterious gases from the insulating oil.

Another object of the present invention is to remove damaging gases from insulating oil by providing a device which processes the oil in an environment below atmospheric pressure.

Another object is to provide a device for processing oil in a closed system.

Another object of the present invention is to provide a device which forces bubbles back into solution while in the housing, then transfers the solution to a processing chamber, then allows the bubbles to be taken out of solution and removed as a gas by an evacuation process in a processing chamber. A coalescing element is employed in some embodiments to aid removal of the gases from the oil.

Other objects and advantages of the present invention will be apparent to those of skill in the art from the teachings disclosed herein and by reference to the attached drawings.

DESCRIPTION OF THE PREFERRED EMBODIMENTS

Figure 1:
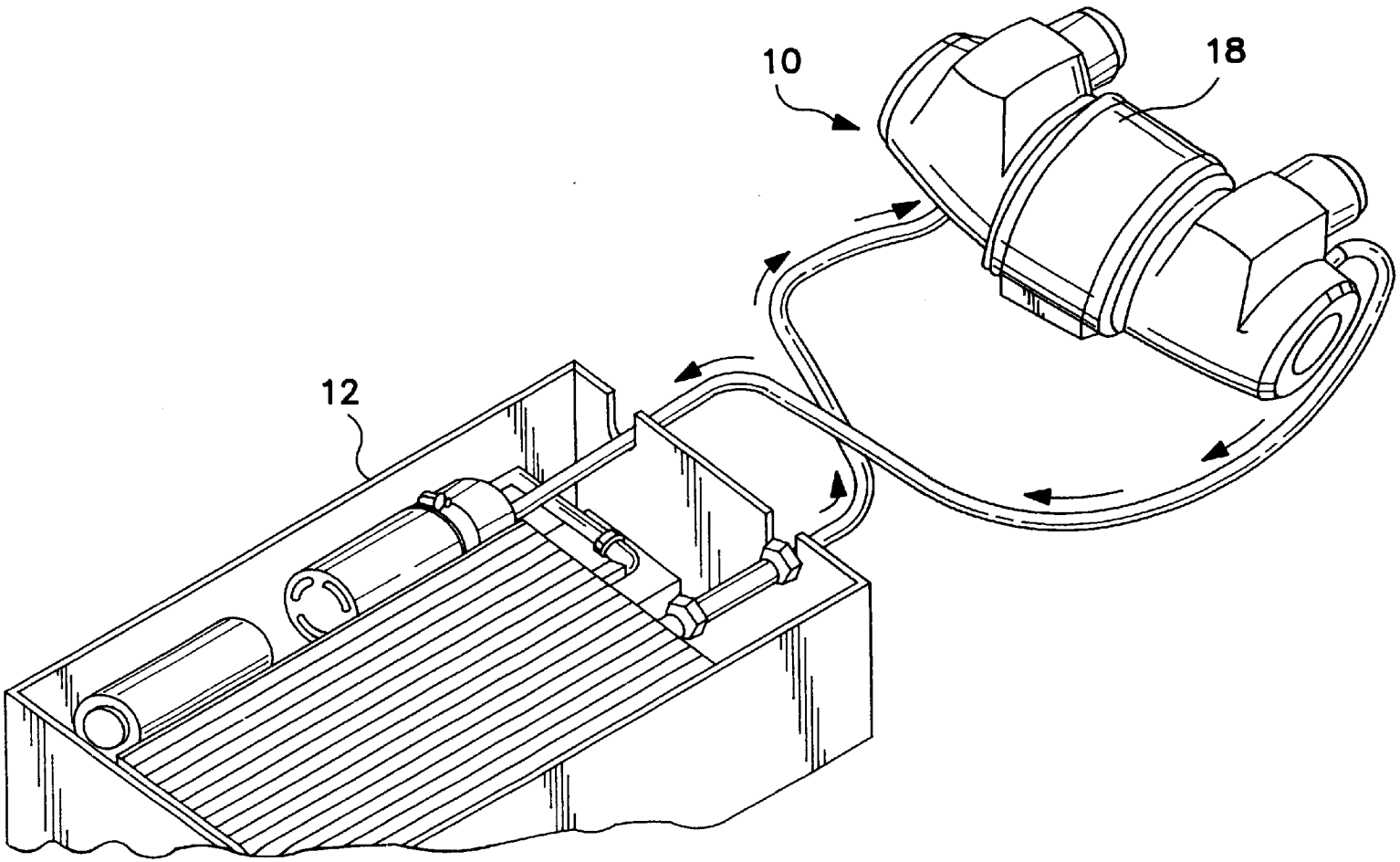
FIG. 1 PRIOR ART
FIG. 1 shows a prior art x-ray tube connected to a heat exchanger.
Figure 2:
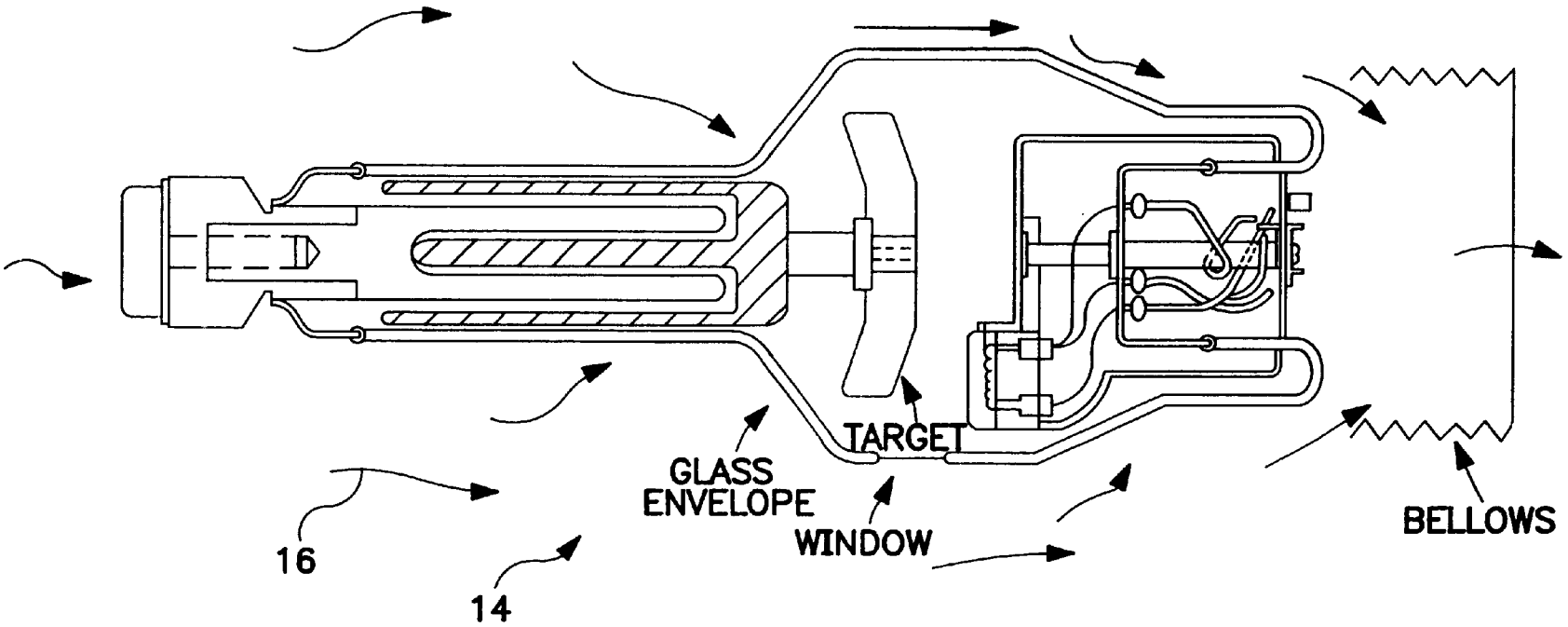
FIG. 2 PRIOR ART
FIG. 2 is a schematic view of a prior art insert for generating x-rays. The insert is placed in a housing of the type shown in FIG. 1. Insulating oil then is circulated around the insert.
Figure 3:
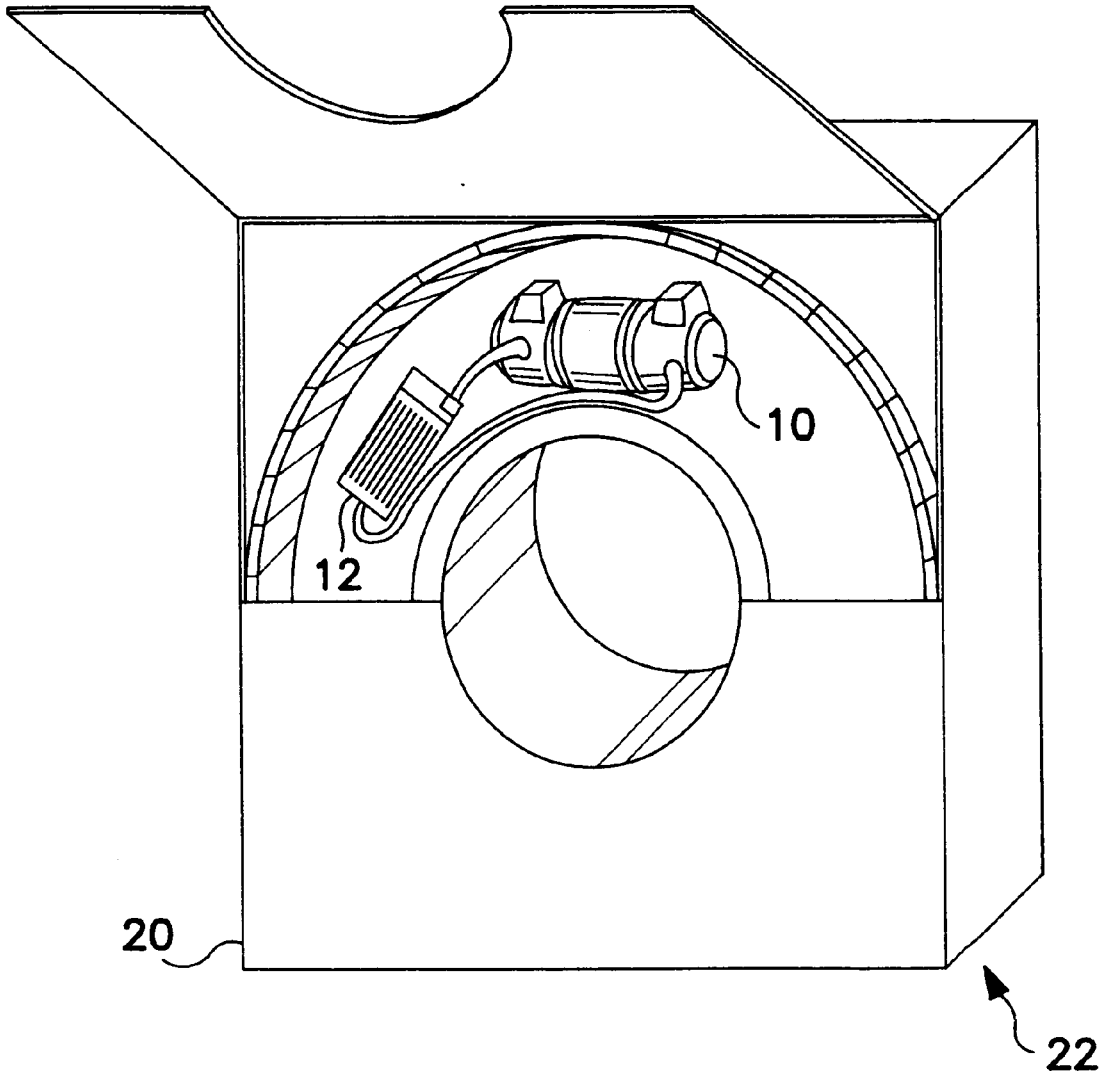
FIG. 3 PRIOR ART
FIG. 3 is a perspective view of a prior art x-ray tube and heat exchanger mounted on a gantry of an x-ray machine.

The present invention relates to methods and apparatus for extending the life of an x-ray tube. FIG. 1 is a prior art drawing showing an x-ray tube 10 fluidly connected to a heat exchanger 12. The x-rays are produced by an insert 14 shown in prior art drawing FIG. 2. A housing 18, shown in FIG. 1, houses the insert 14. The insulating oil 16 shown in FIG. 2 circulates around the insert to provide thermal and electrical insulation. FIG. 3, prior art, depicts the x-ray tube 10 mounted on a gantry 20 of a computer tomography (CT) scanner 22. The machine depicted in FIG. 3 may also be any typical x-ray device.

The following U. S. Patents, which discuss CT scanners, x-ray tubes, and cooling methods, are hereby incorporated herein by reference: U.S. Pat. No. 5,086,449; entitled "Debubbler System for X-Ray Tubes" by Furbee, et al.; U.S. Pat. No. 4,115,697 entitled "X-Ray Tube Cooling Arrangement" by Hounsfield; U.S. Pat. No. 5,012,505 entitled "Fluidic Slip Ring For CT Scanners" by Zupancic, et al.; U.S. Pat. No. 4,622,687 entitled "Liquid Cooled Anode X-Ray Tubes" by Whitaker et al.; U.S. Pat. No. 4,688,239 entitled "Heat Dissipation Means For X-Ray Generating Tubes" by Schaffner, et al.; U.S. Pat. No. 4,767,961 entitled "X-Ray Generator Cooling System" by Koller, et al.; U.S. Pat. No. 4,841,557 entitled "X-Radiator With Circulating Pump For Heat Dissipation" by Haberrecker, et al.; U.S. Pat. No. 4,866,743 entitled "Computer Tomography Apparatus With A Closed Circulation Cooling System" by Kroener; and U.S. Pat. No. 5,732,123 entitled "Method and System For Extending The Service Life Of An X-Ray Tube" by Peralta et al.

As mentioned in the background section, greases and waxes produced during the life of an x-ray tube are not particularly damaging. Gases, however, which are highly absorbable in oil can be particularly damaging to the process of producing x-rays. Because bubbles are a location of reduced insulation, but they can act as a pathway for electrical conduction through the insulating oil more readily than through regions lacking bubbles. Also, gas in solution provides opportunities for chemical disassociation by providing a source of hydrogen and oxygen ions.

As mentioned in the background section the oil is made up of some 3500 separate hydrocarbons. The oil is subjected to a chemical change due to the heat, radiation, arcing and corona phenomena within the x-ray tube. Longer chain molecules break down and recombine with other by-products to form longer and shorter chain molecules.

A shorter chain of molecules may be pure gas, such as acetylene gas $C_2H_6$. $C_2H_6$ is produced primarily during a major high voltage breakdown in oil. Other by-products include hydrogen, which is produced by stripping off a hydrogen ions by arcing or corona discharge. This is primarily due to a corona phenomena.

Note that these gases are formed by manipulations of high voltage in the environment outside the actual x-ray tube insert. This is a key to understanding the nature of tube failure the x-ray machine. It is the insulating oil which is being altered and damaged. When the insulating oil becomes damaged, then the insert becomes damaged due to lack of proper insulation (via the effects of arcing).

One of the keys to the invention is the realization that water is a component in oil which has been subjected to an operating x-ray machine environment. At room temperature the saturation level of water is about 62 parts per million (ppm) in the insulating oil. During the x-ray process, and as the insulating oil breaks down, water can come out of solution (i.e. become a drop, or droplet, in the oil). The water can accumulate in minute droplets on the cooler surfaces of the x-ray tube housing. This is similar to condensation of water vapor on a cooler surface. Thus, water is accumulating inside the housing. The source of water is the oil itself.

Water, while a neutral molecule, supports arcing because of the molecular nature of it. It has a 105° angle between the centers of the molecules. This makes it act as a dipole in a static direct current (dc) field.

In a CT tube, x-ray generation is thousands of times longer than in conventional tubes. In general, the x-ray in a CT scanner stays on for many seconds as opposed to the average milliseconds used in conventional tubes. This results in the insulating oil being exposed to radiation and higher temperatures for a longer time, in any given application. More time, and higher temperature, to expose and radiate the oil results in more disassociations and more water molecules formed to become aligned. A 150 kV dc field is applied during the radiating process. Note that breakdown of the oil at a high field point of occurrence readily strips hydrogen ions from long molecules. The recombination and hydroxyl ions produces free water.

Water is a by-product of some of these disassociations. Water is also a source of some of these disassociation problems. It is a damaging circular relationship during the production of radiation. Thus, it is desirable to remove water from the oil. It should also be noted that, generally speaking, the dielectric properties of the insulating oil (as a whole) are reduced by adding water.

As mentioned, water will act as a dipole in a direct current field. Thus, to preserve, or increase, the dielectric properties of the insulating oil, it would be desirable to remove water. Prior art, adds water to the system by adding new oil. This is bad. Thus, water which has seeped out of the old oil and is clinging to the housing in the insert mixes with the new oil though the water is not absorbed because the new oil is likely saturated with water. That is, the oil is already at its saturation level for water. There is then even more water as a source for more disassociation problems.

The saturation level, or concentration, is a function of the oil temperature. As such, different amounts of gases will come out of solution at different temperatures. Also, different compounds form more readily at different temperatures. For example, acetylene, $C_2H_6$, is believed to form more readily at cooler temperatures as compared to $H_2$ at hotter temperature.

Water, which is absorbable in oil to the level about 60 parts per million at room temperature, should be removed. Embodiments of the present invention remove oil down to 12–20 parts per million at room temperature. Other embodiments can reduce the water of down to 5 to 10 parts per million.

At this point it is important to realize another aspect of the chemical breakdown in decomposition. Initially, all new housings are relatively similar, and new insulating oil is fairly standard. However, through the chemical breakdown which occurs during the x-radiation process, the particular parameters of the housing bond with the particular parameters of the oil in that housing. The more that particular insulating oil breaks down and bonds with that particular housing, the less the oil will break down and form new bonds. Essentially, the oil is subjected to a form of radiation hardening and is particularly tuned to that particular housing. Thus, it is actually preferred to use older oil, preferably oil which has undergone a bonding process, or has bonded, with that particular housing. This further reduces oil disassociation because there are less sources for disassociation. That is, the "parametric cross section" has been reduced.

Each CT tube has an inherent set of parameters. Specific dimensions of oil through which the primary radiation passes for any given tube are wide and varying. Specific stray radiation varies from tube to tube also. Specific voltage setting for any generator have small variabilities as well. Each of these parameters, during the aging, or oil deteriorating process, is more sensitive to specific bonding energies over narrow domains. Many of the bonding energies are insensitive to the deterioration energies of radiation in thermal and corona sources. Thus as a class, bonds are reduced in number for a particular oil-housing pair or combination. Thus, the specific insulating oil in that specific housing has less opportunities to form new bonds.

Figure 4:
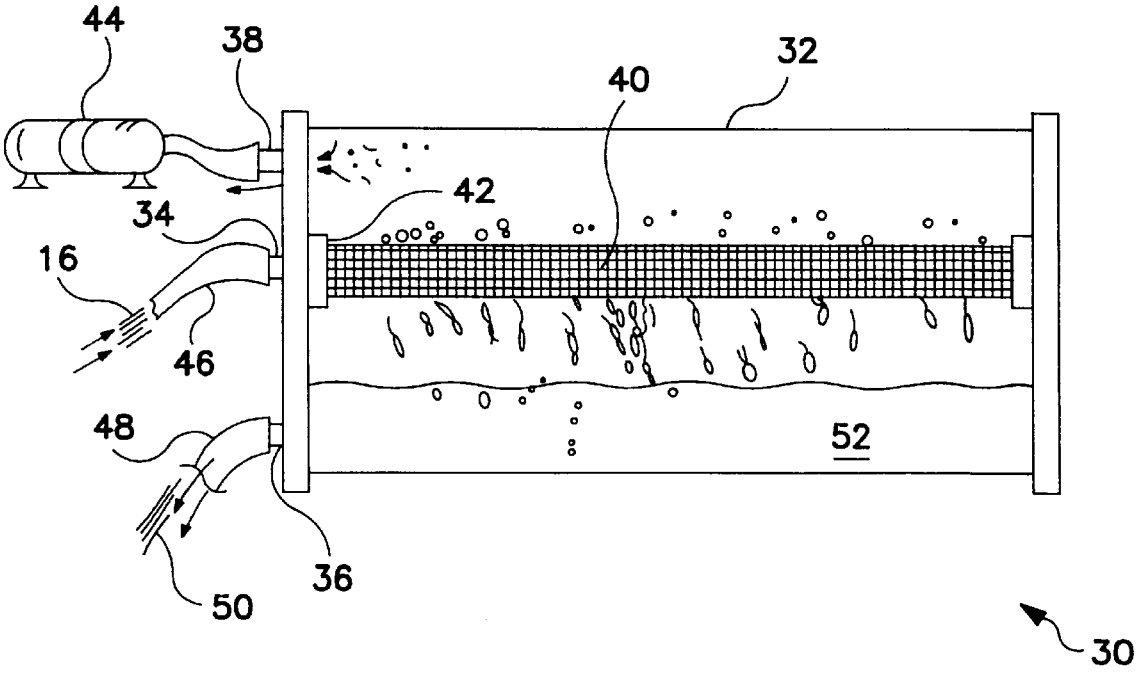
FIG. 4 is an elevated side view depicting a processing chamber of the present invention. A coalescing element in the processing chamber is shown removing water from oil. Oil is shown dripping from the coalescing filter.

Accordingly, one embodiment of the present invention is for an x-ray tube oil processor 30 shown in FIG. 4. The x-ray tube oil processor 30 is for extending the life of an x-ray tube 10 by processing oil 16 for the x-ray tube 10, wherein the oil 16 is adapted to circulate around the insert 14 in the housing 18 of the x-ray tube 10.

Figure 5:
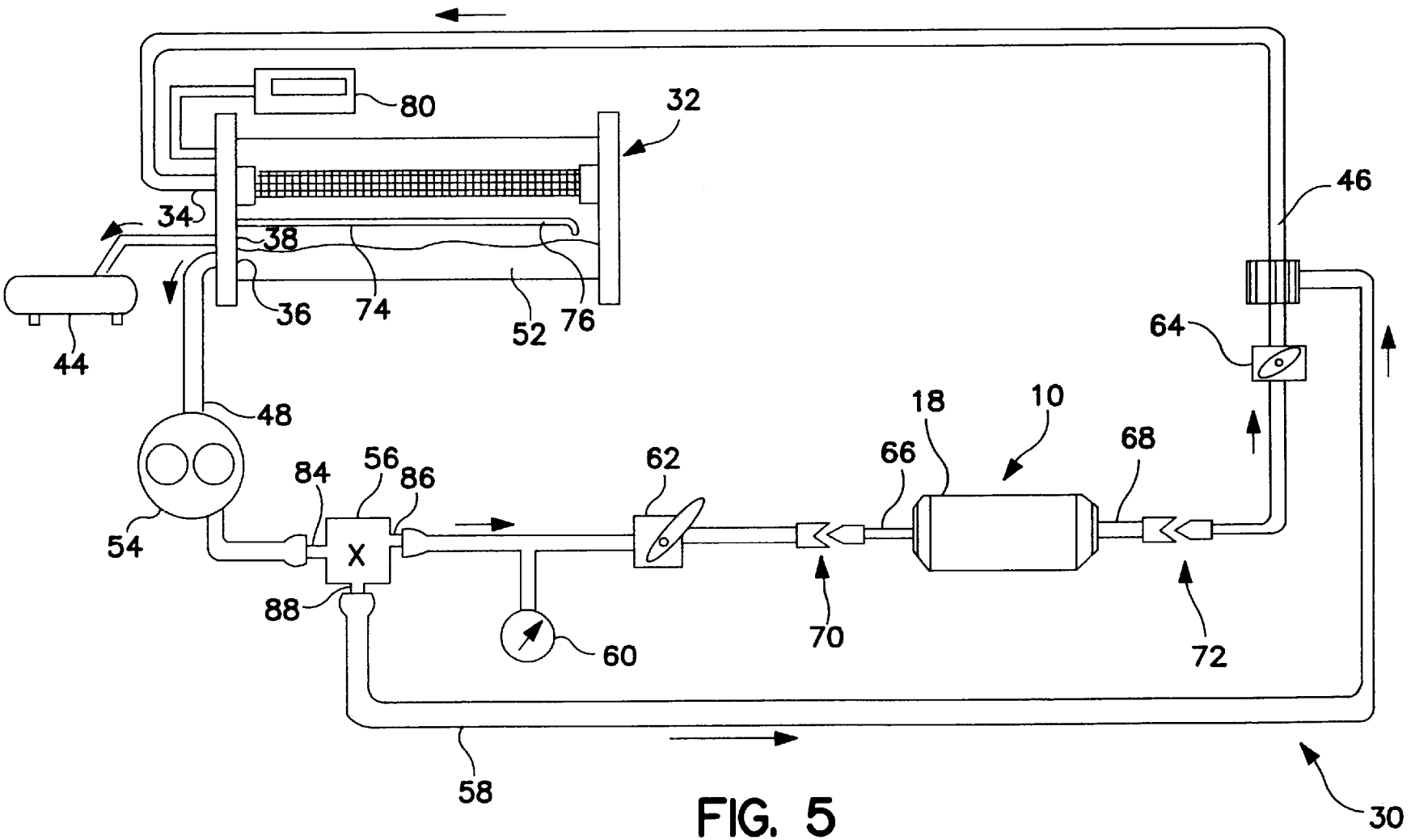
FIG. 5 shows a schematic representation of the present invention connected to an x-ray tube.
Figure 6:
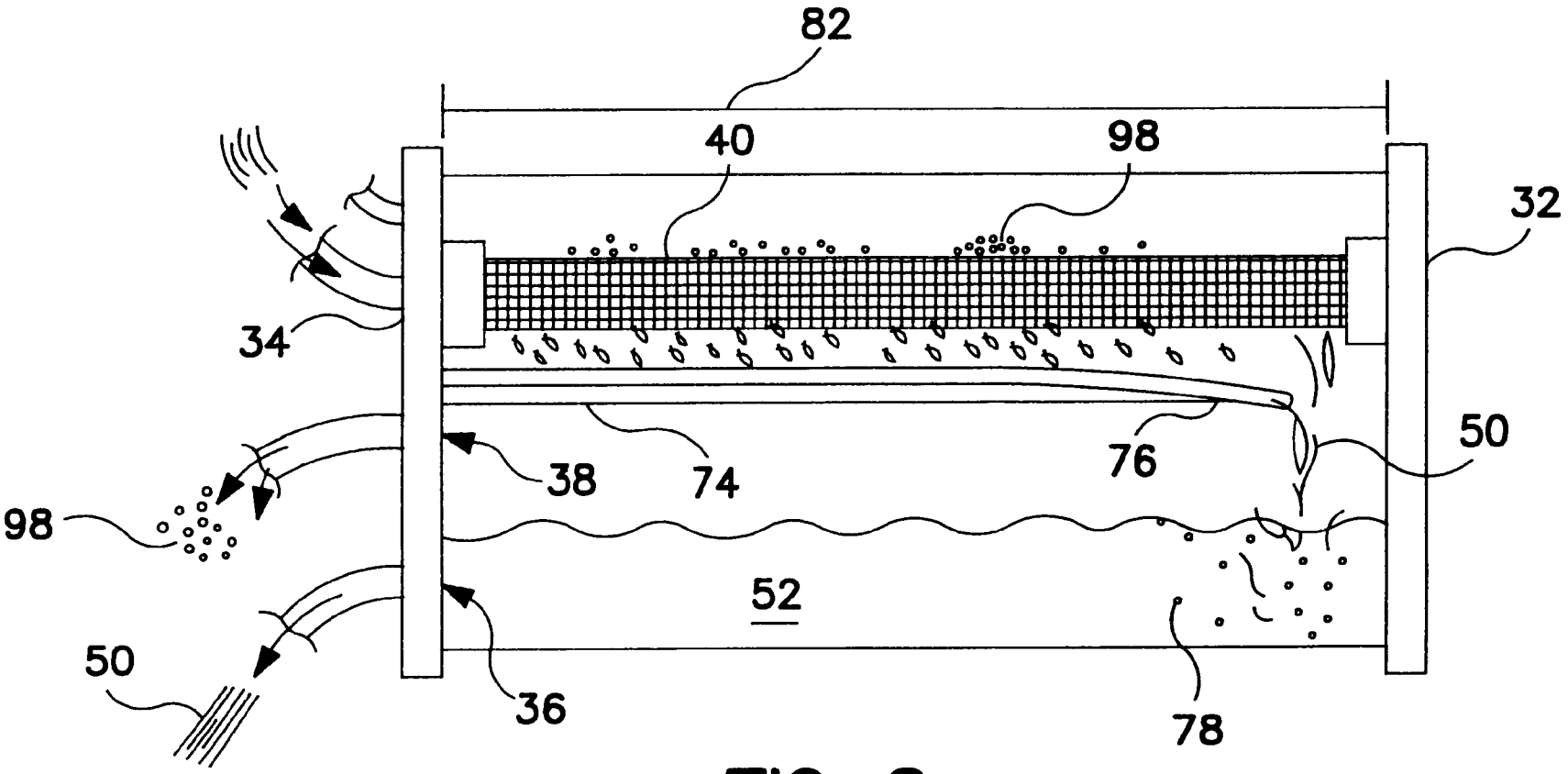
FIG. 6 shows a close up of a processing chamber of the present invention. The processing chamber in FIG. 6 includes a flow director for directing the dripping oil from the coalescing element away from the oil outlet of the processing chamber.

The processor 30 comprises a processing chamber 32 having an oil inlet 34 an oil outlet 36 a gas outlet 38. The processor 30 also includes a coalescing element 40 positioned in the processing chamber 32 wherein the coalescing element 40 has a first end 42 in fluid communication with the oil inlet 34. A vacuum source 44 is in fluid communication with the gas outlet 38. Preferably the gas outlet 38 is above the oil inlet 34 reduce the likelihood of drawing oil, or oil foam, through the gas outlet 38 and then through the vacuum source 44. This embodiment is shown in FIG. 4, FIGS. 5 and 6 show the gas outlet 38 below the coalescing element 40.

An oil inlet hose 46 and an oil outlet hose 48 are respectively in fluid communication with the oil inlet 34 and the oil outlet 36 of the processing chamber 32. The oil 16 enters the oil inlet hose 46 and passes through the coalescing element 40 and exits the oil outlet hose 48 as processed oil 50. One preferred vacuum pump is produced by Robinair 15234 using motor below.

In the embodiment shown in FIG. 4 the processor 30 comprises a sump of oil 52 in the processing chamber 32. In some embodiments, for some applications, it is preferred that the sump of oil 52 comprises radiation hardened oil. Radiation hardened oil being oil which has been exposed to x-rays. Preferably the oil has "bonded" with that housing by having been exposed to radiation over a period of time in that housing. However, exposing oil to radiation, of the same general category that the x-ray tube for which the insulating oil 16 is being processed produces radiation, is also useful.

In a preferred embodiment the coalescing element 40 is located above the oil sump 52, as shown in FIG. 4.

Refer now to FIG. 5 which shows a schematic layout of the oil processor 30 connected to an x-ray tube 10. In the embodiment shown in FIG. 5, the processor 30 comprises an oil pump 54 in fluid communication with the oil outlet hose 48. Preferably the oil pump 54 is a gear pump. One acceptable gear pump is Tuthill DDS1.6

A relief valve 56 is also shown fluidly connected to the oil outlet hose 48. A relief hose fluidly connects the relief valve 56 to the oil inlet hose 46.

A pressure gauge 60 is fluidly connected to the outlet hose 48. The pressure gauge can be used to determine the pressure in the housing. One acceptable pressure gauge is Ashcraft 1007PH.

In some embodiments, as is shown in FIG. 5, the processor 30 comprises an outlet flow valve 62 in line with the oil outlet hose 48. An inlet flow valve 64 is shown in line with the oil inlet hose 46. The oil outlet hose 48 shown in FIG. 5 is adapted to connect to the x-ray tube 10 housing 18, and the oil inlet hose 46 is adapted to connect to the x-ray tube 10 housing 18. The x-ray tube housing 18 shown in FIG. 5 includes an oil in hose 66 and an oil out hose 68. The oil outlet hose 48 is connected to the oil in hose 66 and the oil inlet hose 46 is connected to the oil out hose 68.

Figure 10:
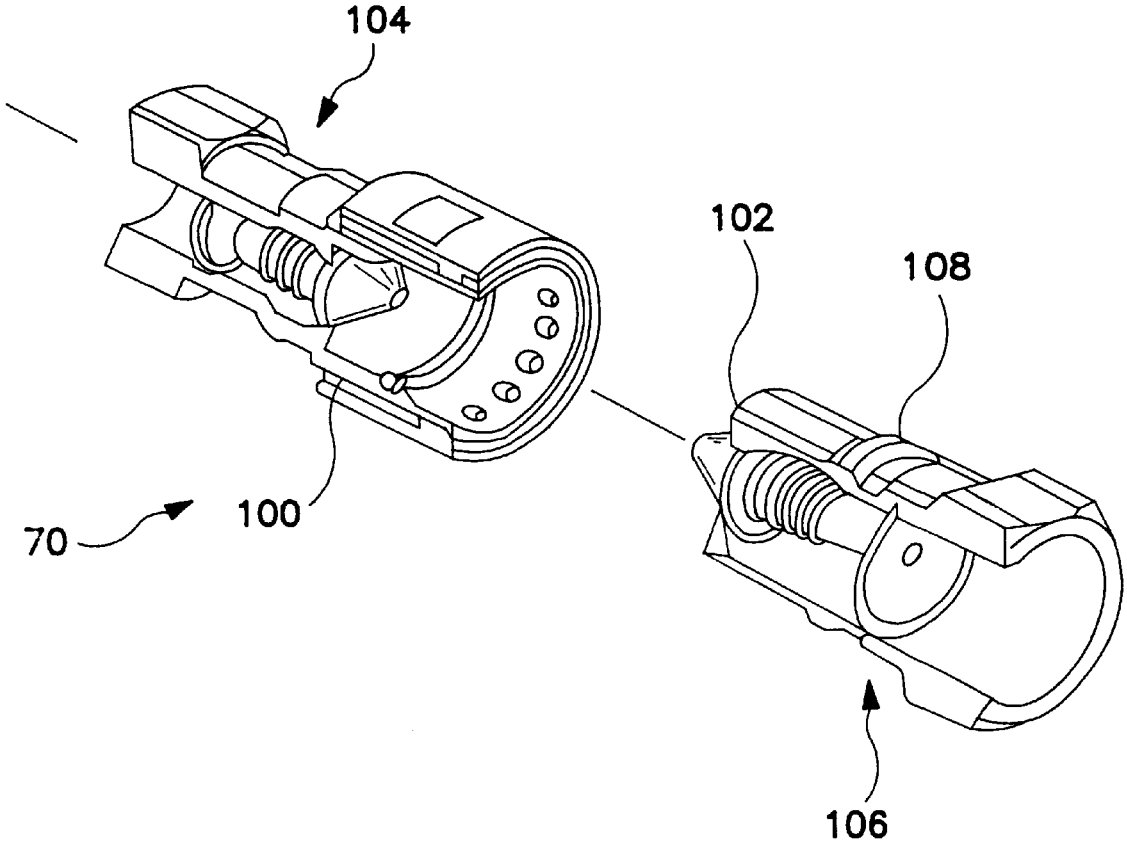
FIG. 10 PRIOR ART
FIG. 10 is an exploded cutaway view of a prior art quick-connector.

As shown in FIG. 5, the processor 30 comprises a first quick-connect 70 connecting the oil outlet hose 48 and the oil in hose 66, as well as a second quick-connect 72 connecting the oil inlet hose 46 and the oil out hose 68. FIG. 10 shows a representative quick-connect 70. The quick-connect (or quick-disconnect) 70 shown in FIG. 10 includes a double O-ring 100 around the perimeter and a bevel connection 102 at the interface of the conforming pieces 104 and 106. Conforming piece 106 includes a triangular shaped lip 108 around its perimeter which abuts the edge of conforming piece 104 when the two pieces are mated.

An acceptable hydraulic connector, which is a quick-coupling, is produced by Parker Fluid Connectors in the Quick-Coupling Division located in Minneapolis, Minn. Refer to FIG. 10

Preferably the processor comprises a flow controller 74 proximate the coalescing element 40. The flow controller 74 has a discharge portion 76 located away from the oil outlet 36. This is shown more clearly in FIG. 6. By locating the discharge portion 76 of the flow controller 74 away from the oil outlet 36 of the processing chamber 34 gas bubbles 78 are prevented from entering the oil outlet 36. If gas bubbles enter the oil outlet 36 and pass through the oil outlet hose 48 they will damage the gear pump 54 and prevent it from working. It is also desirable to prevent an air bubble from being transmitted into the housing 18 of the x-ray tube 10. A bubble in an x-ray tube could be catastrophic to the tube, and damaging to the scanner. Since tube cost from $15,000 to $100,000, and the scanners cost from $300,000 to $1.2 M., the risk is very real.

A vacuum gauge 80 is operably connected to the processing chamber 32. One preferred electronic vacuum gauge is that produced by JB Industries, Inc. of Aurora, Ill. 60507. When the oil processing is started pressure in the processing chamber 32 may typically be on the order of 700 microns. In some embodiments it is sufficient to evacuate the chamber down to 200 microns. In some preferred embodiments it is desirable to evacuate the chamber down to 20 microns. Evacuation of the processing chamber 32 removes gases from the processing chamber 32. Since the oil is processed, preferably, in a closed system the evacuation process is taking gases out of the oil. The reduced pressure in the chamber is an indication of this since the oil in the closed system is not reduced. In some preferred embodiments the processing chamber 32 is transparent. This allows the process to be visually monitored and to note the out-gassing from the oil. It is not required that the processing chamber 32 be transparent to monitor the process, however, because the process can be monitored by monitoring pressures in the processing chamber 32 as well as pressures in the housing 18.

Preferably the processing chamber 32 comprises a length 82, shown in FIG. 6, and the coalescing element 40 extends across the length 82 of the processing chamber 32.

While a variety of coalescing filters will be apparent to those of skill in the art, the coalescing element 40 depicted in FIGS. 4 and 6 is a hollow cylindrical tube comprising very fine highly compressed shards and strips of fiberglass. The tube is then enclosed with a fine nylon wire mesh having openings on the order of 0.01 to 0.05 inch. The multitude of shards in the fiberglass act to create thin films which coalesce or collect the gases, preferably water, and out-gas the collected gas from the oil. Adjusting the pressure in the processing chamber, via evacuation, aids out-gassing.

In one preferred embodiment the relief valve 56 comprises an inport 84, an outport 86, and a relief port 88. The relief hose 58 connects the relief port 88 to the oil inlet hose 46. Preferably the oil pump 54 is downstream of the outlet valve 62 and the relief valve 56 is downstream of the oil pump 54. The pressure gauge 60 is connected to the oil outlet hose 48 downstream of the relief valve 56 in the configuration shown in FIG. 5.

Figure 7:
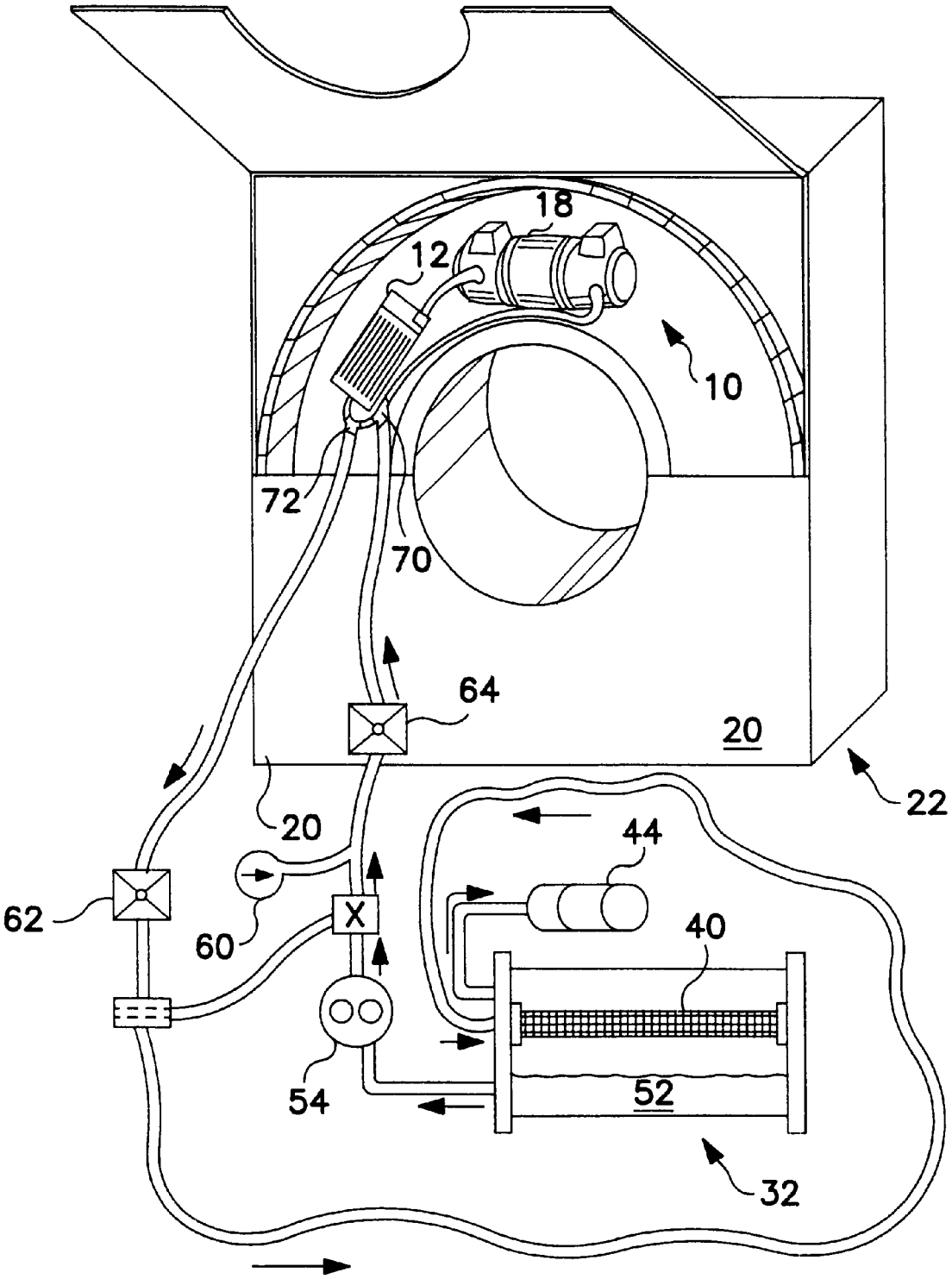
FIG. 7 shows a perspective view of the present invention connected to an x-ray tube mounted on a gantry.

In many instances it will be desirable to maintain the x-ray tube 10 on the gantry 20 of the CT scanner 22. Thus the oil outlet 36 of the processing chamber 32 is attached to the housing 18 and the oil inlet 34 is attached to the housing 18 while the housing 18 is mounted in the gantry 20. This is shown in FIG. 7.

Since it will be desirable to perform the oil processing while the x-ray tube is mounted on a gantry, it will be desirable to have the oil processor portable. Accordingly, one embodiment of the present invention is for an x-ray tube processing kit 90 for processing oil 16 in an x-ray tube 10 housing 18 wherein the housing 18 is mounted on a gantry.

Figure 8:
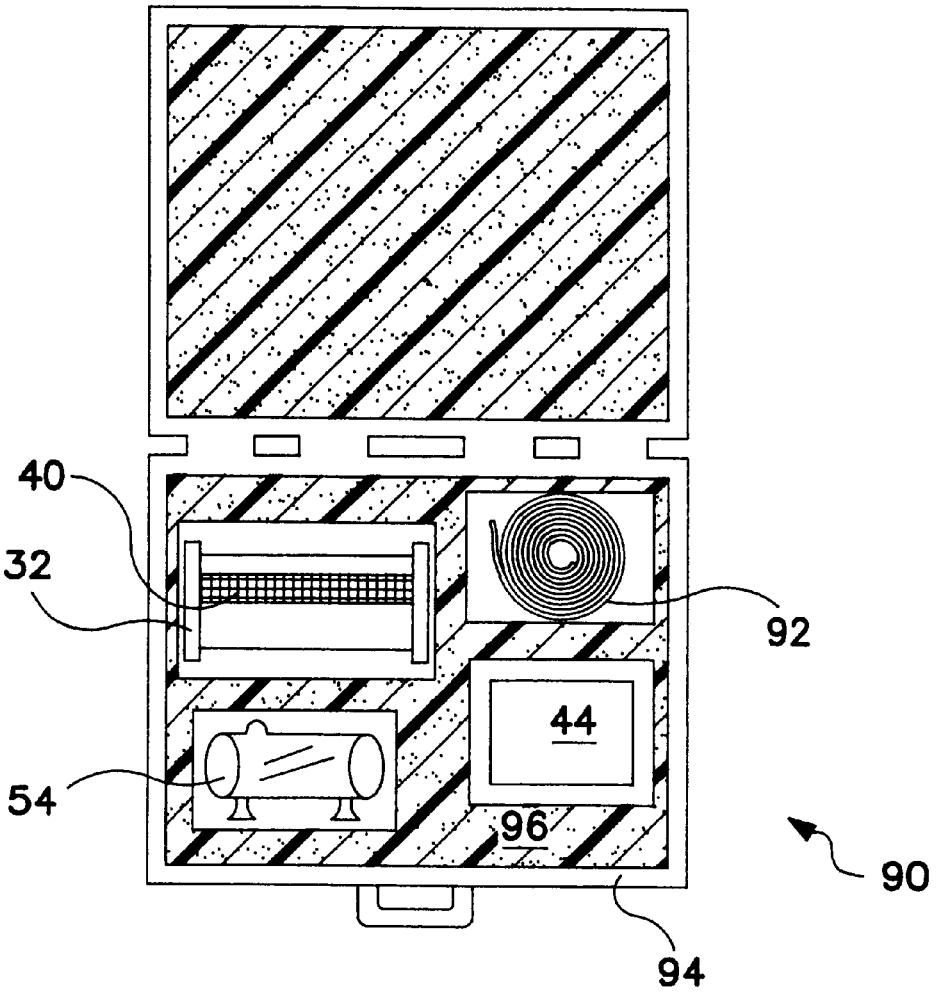
FIG. 8 shows an view of a processing kit of the present invention.
Figure 9:
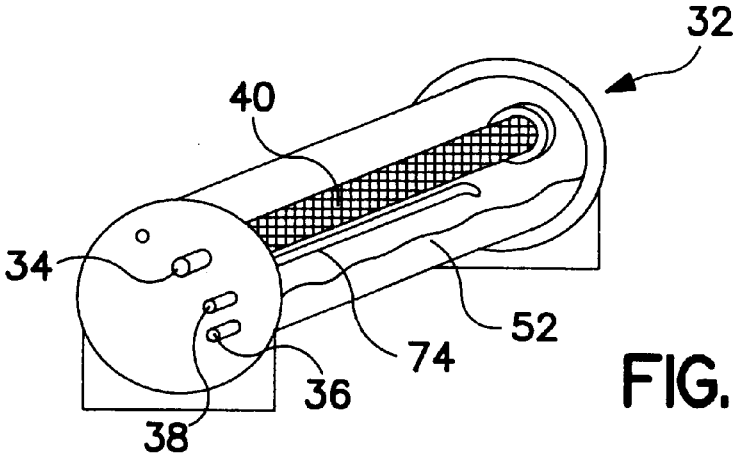
FIG. 9 shows a perspective view of a processing chamber similar to the one shown in FIG. 6.

Referring to FIG. 8 the kit 90 comprises a processing chamber 32 containing a coalescing element 40; a plurality of fluid hoses 92 adapted to connect to the processing chamber 32; an oil pump 54 adapted to connect to one of the plurality of fluid hoses 92; and a vacuum pump 44 adapted to connect to the processing chamber 32. A one preferred source of fluid hoses is Ritchie In one embodiment the plurality of fluid hoses 92 comprises at least two hoses fluidly connected to valves (see FIG. 5) including the one hose being adapted to connect to the oil pump 54.

Preferably the kit 90 includes a plurality of quick-connectors (not shown in FIG. 8). Also it will be desirable if the kit 90 includes a quick-connector kit for positioning a quick-connector in-line between the housing 18 and a heat exchanger 12, wherein the heat exchanger 12 is mounted on the gantry 20, and wherein the oil 16 is adapted to circulate through the heat exchanger 12 and the housing 18.

Preferably the kit 90 comprises a carrying case 94 for transporting the processing chamber 32. Generally it will be desirable if the carrying case 94 comprises foam padding 96 for securing the kit components in place. Preferably the carrying case 94, the oil pump 54, the vacuum pump 44, and the processing chamber 32 are sized such that the processing chamber 32, the vacuum pump 44, and the oil pump simultaneously fit in the carrying case 94. It is desirable to have the kit weight less than 40 kilos. This facilitates international transportation of the kit.

More generally the present invention includes a method of extending the life of an x-ray tube 10 having a housing 18 and an insert 14 located therein for producing x-rays. The method comprises the steps of providing the x-ray tube 10 with an insulating oil 16 in the housing 18; and processing the insulating oil 16 to remove deleterious gases 98 from the oil. See FIG. 6.

Preferably the step of processing the oil 16 to remove deleterious gases 98 from the oil 16 comprises removing water from the oil wherein the water is removed as a gas.

The method may also include the step of drying the housing by removing water. This is accomplished when processed oil 50 circulates through the housing 18. Since the processed oil 50 is dryer than the housing 18 the processed oil will absorb water in the housing 18 which will then be removed from the oil by the coalescing element 40 (in some preferred embodiments).

Typically the deleterious gas 98 includes water vapor and the step of processing includes transporting the oil through a coalescing element 40, out-gassing the deleterious gases 98 from the oil 16 (or 50) and removing water from the oil 16 (or 50). Recall, the 50 indicates oil which has passed through the coalescing element 40 and has been "processed." However, the oil 16 and the processed oil 50 readily mix. So it is desirable to continually circulate and process the oil until a desired dryness is reached. The desired dryness can be "measured" by reference to pressures in the processing chamber 32. Thus, the terms oil 16 and oil 50 are used interchangeably except where reference to processed oil 50 facilitates understanding of the invention. One exemplary apparatus for accomplishing this is shown in FIGS. 5 and 6.

One embodiment of the method comprises locating the coalescing element 40 in a processing chamber 32; fluidly connecting the housing 18 to an inlet 34 of the processing chamber 32. The method also includes the step of evacuating the processing chamber 32 as oil 16 in the housing 18 is transported through the processing chamber 32 inlet 34 and through the coalescing element 40, wherein the oil 16 exiting the coalescing element is processed oil 50. See FIG. 6.

Referring to FIG. 5 as an exemplary embodiment, the method also comprises the step of fluidly connecting an outlet 36 of processing chamber 32 to the housing 18 and transporting the processed oil 50 to the housing 18.

Referring to FIG. 6, some embodiments of the method comprise the steps of placing a sump of oil 52 in the processing chamber 32; and allowing the processed oil 50 to mix with the oil in the sump. Thus the step of transporting the processed oil to the housing includes transporting sump oil to the housing. Preferably the method comprises utilizing radiation hardened oil in the sump of oil.

Thus it will be apparent to those of skill in the art that the method in some embodiments will comprise the steps of circulating oil 16 from the housing 18 through the coalescing element 40 through the sump of oil 52 and back to the housing 18. Also included in the method are steps of removing gases from the oil 16 as it passes through the coalescing element 40; and continuing to circulate the oil 16 until a desirable level of gas has been removed from the oil.

In some preferred embodiments the method comprises the steps of aligning a first end 42 of the coalescing element 40 over the processing chamber inlet 34; supporting the coalescing element 40 above the sump of oil 52. The step of transporting the oils 50 to the housing 18 includes pumping the oil 50 to the housing 18. The step of evacuating the processing chamber 32 includes evacuating the deleterious gases 98 out-gased from the oil 16. This is shown in FIG. 6.

It is desirable to prevent a bubble 78 from being sucked through the processing chamber outlet 36 for the reasons previously discussed. This is most easily accomplished by locating the processing chamber outlet 36 away from where the oil exiting the coalescing element 40 enters the sump of oil 52. In FIG. 6 this is accomplished by use of a flow controller 74.

In some embodiments it is preferred that the step of circulating the oil through the housing is at a positive pressure. This prevents bubbles from coming out of solution while they are in the housing. The step of circulating the oil 16 in a positive pressure occurs prior to evacuating the deleterious gases 98 from the processing chamber 32, in some preferred embodiments. This helps prevent a bubble from forming in the housing 18. Some embodiments of the method comprise the step of adjusting pressure in the housing by regulating oil flow into and out of the housing. In some instances, it is desirable to build up to a positive pressure of about 15 psi in the housing, then begin processing, then operate at a neutral or slightly positive pressure, or thereabouts, in the housing.

Preferably, the method of processing the oil comprises maintaining the xray tube 10 on the gantry 20 of the x-ray machine 22.

It will be apparent to those of skill in the art that the method also comprises the steps of locating the coalescing element 40 in a processing chamber 32 having an inlet 34 an outlet 36 and an evacuation port 38. The evacuation port 38 is also referred to as a gas outlet. The method also comprises fluidly connecting the housing 18 to the processing chamber inlet 34; fluidly connecting the housing 18 to the processing chamber outlet 36; and connecting a vacuum source 44 to the processing chamber evacuation port 38. The method also includes evacuating gases 98 from the processing chamber 32 and circulating oil 16 and 50 through the processing chamber. Preferably the steps of fluidly connecting the housing 18 to the inlet 34 and the outlet 36 of the processing chamber 32 comprises the step of inserting quick-connects 70 and 72 in oil flow lines between the housing 18 and a heat exchanger 12 on a gantry 20. See FIG. 7.

In some embodiments the method of processing the oil 16 comprises the steps of locating the coalescing element 40 above a sump of oil 52 in the processing chamber 32. The method also comprises positioning the coalescing element 40 relative to the processing chamber 32 inlet 34 such that oil 16 entering the processing chamber 32 through the processing chamber inlet 34 must pass through the coalescing element 40.

Preferably the step of circulating the oil at a positive pressure through the housing comprises the step of pumping the oil into the housing to increase pressure in the housing prior to allowing oil to flow out of the housing. Thus, oil from the sump of oil is forced into the housing to increase pressure in the housing and aid forcing any bubbles in the housing back into solution. The oil is then allowed to flow through the lines and through the coalescing filter. When the oil flows through the coalescing element, water and other gases are out-gased from the oil. This processed oil is then transported back to the housing.

Some preferred embodiments of the present invention comprise placing a relief valve 56 in line between the oil pump 54 in the housing 18; connecting a relief port 88 on the relief valve 56 to the processing chamber inlet.

Preferably the method also includes adjusting an inlet valve 64, also referred to as an inlet flow valve, 64 and an outlet flow valve, also referred to as an outlet flow valve, 62 to regulate pressure in the housing 18. The inlet valve 64 is in-line between the housing 18 and the processing chamber inlet 34, and the outlet valve 62 is in line between the housing 18 and the processing chamber outlet 36. The processing chamber inlet is also referred to as the oil inlet and the processing chamber outlet is also referred to as the oil outlet.

Due to the damage which may be caused by excessive or minimal pressure in the housing, one embodiment in the method comprises monitoring pressure in the housing. Another embodiment comprises the step of monitoring pressure in the processing chamber. Typically, the step of monitoring pressure in the housing is accomplished via an oil pressure gauge. The step of monitoring pressure in the processing chamber is accomplished via a vacuum gauge.

Since different out-gases come out of solution at different temperatures one embodiment comprises the step of out-gassing gases formed at higher temperatures by heating the oil. Another comprises the step of out-gassing gases formed at colder temperatures by cooling the oil.

Another method of extending the life of an x-ray tube having a housing and an insert located therein for producing x-rays comprises the step of providing an insulating oil in the housing; and drying insulating oil.

In some embodiments the step of drying the insulating oil comprises removing water from the insulating oil. Oil is highly deliquescent, similar to pure grain alcohol. The oil seeks water which is has condensed onto the outer cooler housing wall in the form of microscopic droplets. Thus, changing oil can aid the removal of saturated water, but it cannot remove absorbed water, except for what has gone into solution. Therefore, drying the oil, similar to wringing out a towel, allows the, now dryer, oil to absorb more water, which is in turn "wrung out" of the oil. The process is repeated until a sufficient level of dryness is achieved, i.e. water is removed. As has previously been discussed, this may be accomplished through use of a coalescing element, though other devices and methods will be apparent to those of skill in the art.

In some embodiments the step of removing water comprises reducing the water saturated in the oil. In one embodiment this includes reducing a parts of water per million parts of oil level to at least twenty parts of water per million parts of oil. The standard for most x-ray tube oil is on the order of thirty parts per million, wherein this is considered "dry." Thus, one embodiment of the invention is to improve performance by providing improved oil.

As will be clear from the teachings herein, the method may also comprise the step of drying an interior (not shown) of the housing 18. This may be accomplished by circulating the insulating oil 16 through the housing 18, wherein the insulating oil 16 is drier than the housing 18; and allowing the drier insulating oil to absorb water in the housing. The method also includes the step of removing the absorbed water from the insulating oil. In many instances it is preferred that the step of drying the insulating oil occurs while maintaining the x-ray tube on a gantry of an x-ray machine.

Another embodiment comprises the removal of aromatic hydrocarbons. This is beneficial because the insulating qualities of hydrocarbons is generally not suitable.

Another embodiment comprises the steps of hardening oil and introducing the hardened oil into an environment or chamber. In one version, the environment is a cooling chamber of a nuclear power plant. The hardening is carried out using a radiation source in treatment chamber, wherein the treatment chamber is separate from the cooling chamber.

Another embodiment comprises the steps of out-gassing gases and capturing the gases. In one embodiment, the gases are captured in a balloon-trap to more readily illustrate the quantity of gases taken out of solution.

One embodiment of the processing kit comprises a processing chamber containing a coalescent filter; and a plurality of fluid hoses adapted to connect to the processing chamber. The kit preferably includes an oil pump wherein both the processing chamber and the oil pump are adapted to allow oil to be maintained in both elements during shipping while preventing oil from spilling out. Upon set up, the oil will be gravity feed into the respective components.

Thus, although there have been described particular embodiments of the present invention of a new and useful X-Ray Tube Processor, it is not intended that such references be construed as limitations upon the scope of this invention except as set forth in the following claims.

What is claimed is:

1. A method of extending the life of an x-ray tube having a housing, an insert located therein for producing x-rays, and insulating oil in the housing, the method comprising:

processing the insulating oil to remove water as a gas from the oil;

moving the oil through a coalescing element located in a processing chamber having an inlet and an outlet, and fluidly connecting the x-ray tube housing to the processing chamber inlet and outlet;

evacuating the processing chamber as oil is moved through the processing chamber inlet and through the coalescing element and out-gassing the water as water vapor from the oil, wherein the oil exiting the coalescing element is processed oil;

placing a sump of oil in the processing chamber;

allowing the processed oil to mix with the oil in the sump; and transporting the processed and sump oil to the housing.

2. The method of claim 1, comprising circulating the oil through the housing at a positive pressure.

3. The method of claim 2, comprising creating a positive pressure in the housing prior to evacuating deleterious gases from the processing chamber.

4. The method of claim 1, comprising maintaining the x-ray tube on a gantry of an x-ray machine.

5. The method of claim 4, comprising circulating the oil at a positive pressure through the housing.

6. The method of claim 5, wherein circulating the oil at a positive pressure through the housing comprises pumping the oil into the housing to increase pressure in the housing prior to allowing oil to flow out of the housing.

7. The method of claim 1, comprising utilizing radiation hardened oil in the sump of oil.

8. The method of claim 1, comprising:

circulating oil from the housing through the coalescing element through the sump of oil and back to the housing;

removing gases from the oil as it passes through the coalescing filter; and continuing to circulate the oil until a desirable level of gas has been removed from the oil.

9. The method of claim 1, comprising:

aligning a first end of the coalescing element over the processing chamber inlet;

supporting the coalescing element above the sump of oil, wherein:

transporting the oil to the housing comprises pumping the oil to the housing, and evacuating the processing chamber comprises evacuating from the chamber the deleterious gases out-gassed from the oil.

10. The method of claim 1, comprising preventing a bubble from being sucked through the processing chamber outlet.

11. The method of claim 10, wherein preventing a bubble from being sucked through the processing chamber outlet comprises locating the processing chamber outlet away from where the oil exiting the coalescing element enters the sump of oil.

12. The method of claim 1, comprising directing oil exiting the coalescing element away from the processing chamber outlet with a flow controller.

13. The method of claim 1, comprising adjusting pressure in the housing by regulating oil flow into and out of the housing.

14. The method of claim 4, comprising inserting quick-connects in oil flow lines between the housing and a heat exchanger on the gantry.

15. The method of claim 1, comprising:

locating the coalescing element above a sump of oil in the processing chamber; and positioning the coalescing element relative to the processing chamber inlet such that oil entering the processing chamber through the processing chamber inlet must pass through the coalescing filter.

16. The method of claim 1, comprising:

placing a relief valve in line between an oil pump and the housing;

connecting a relief port on the relief valve to the processing chamber inlet; and adjusting an inlet valve and an outlet valve to regulate pressure in the housing; wherein the inlet valve is in line between the housing and the processing chamber inlet, and the outlet valve is in line between the housing and the processing chamber outlet.

17. A method of extending the life of an x-ray tube having a housing, an insert located therein for producing x-rays, and insulating oil in the housing, the method comprising:

processing the insulating oil to remove water as a gas from the oil;

moving the oil through a coalescing element located in a processing chamber having an inlet and an outlet, and fluidly connecting the x-ray tube housing to the processing chamber inlet and outlet;

connecting a vacuum source to an evacuation port of the processing chamber;

evacuating the processing chamber as oil is moved through the processing chamber inlet; and circulating oil through the processing chamber.

18. The method of claim 17, comprising monitoring pressure in the housing.

19. The method of claim 17, comprising monitoring pressure in the processing chamber.

20. The method of claim 17, comprising out-gassing gases formed at higher temperatures by heating the oil.

21. The method of claim 17, comprising out-gassing gases formed at colder temperatures by cooling the oil.

22. A method of extending the life of an x-ray tube having a housing and an insert located therein for producing x-rays, and insulating oil in the housing, the method comprising:

outside of the housing, processing oil to remove water from the oil;

circulating the oil to through the housing, and allowing the oil to absorb water in the housing; and removing the oil with the absorbed water.

23. The method of claim 22, comprising removing water previously in the housing from the oil and returning the oil to the housing.

24. The method of claim 22, comprising reducing a water-per-oil measurement of the oil after it has absorbed water from the housing to less than 30 parts of water per million parts of oil.

25. The method of claim 22, wherein the step of removing water comprises processing the oil through a coalescing filter located outside of the housing.

26. The method of claim 22, comprising maintaining the x-ray tube on a gantry while removing water from the oil, and fluidly connecting a processing chamber to the x-ray tube housing, wherein water is removed from the oil while in the processing chamber and then the oil is returned to the housing is a dryer state than when the oil was removed from the housing.

27. An x-ray tube oil processor for extending the life of an x-ray tube by processing oil for an x-ray tube, wherein the oil is adapted to circulate around an insert in a housing of the x-ray tube, and wherein the processor comprises:

a processing chamber having an oil inlet, an oil outlet, and a gas outlet;

a coalescing element positioned in the processing chamber, wherein the coalescing element has a first end in fluid communication with the oil inlet;

a vacuum source in fluid communication with the gas outlet; and an oil inlet hose and an oil outlet hose respectively in fluid communication with the oil inlet and the oil outlet of the processing chamber, and wherein the oil enters the oil inlet hose, passes through the coalescing element, and exits the oil outlet hose.

28. The processor of claim 27, comprising a sump of oil in the processing chamber.

29. The processor of claim 28, wherein the sump of oil comprises radiation hardened oil.

30. The processor of claim 28, comprising a flow controller proximate the coalescing element, wherein the flow controller has a discharge portion located away from the oil outlet.

31. The processor of claim 28, wherein the element is above the oil sump.

32. The process of claim 28, comprising an oil pump in fluid communication with the oil outlet hose.

33. The processor of claim 32, comprising a relief valve fluidly connected to the oil outlet hose.

34. The processor of claim 33, comprising a relief hose fluidly connected to the relief valve and the oil inlet hose.

35. The processor of claim 33, comprising a pressure gauge fluidly connected to the oil outlet hose.

36. The processor of claim 35, comprising:

an outlet flow valve in-line with the oil outlet hose; and an inlet valve in-line with the oil inlet hose, wherein the oil outlet hose is adapted to connected to the x-ray tube housing, and the oil inlet hose is adapted to connect to the x-ray tube housing.

37. The processor of claim 36, wherein the x-ray tube housing includes an oil-in hose and an oil-out hose, and wherein the oil outlet hose is connected to the oil-in hose and the oil inlet hose is connected to the oil-out hose.

38. The processor of claim 37, comprising:

a first quick-connect connecting the oil outlet hose and the oil-in hose; and a second quick-connect connecting the oil inlet hose and the oil-out hose.

39. The processor of claim 32, comprising:

an outlet valve in-line with the outlet hose; and an inlet valve in-line with the inlet hose.

40. The processor of claim 27, comprising a vacuum gauge operably connected to the processing chamber.

41. The processor of claim 27, wherein the processing chamber is transparent.

42. The processor of claim 27, wherein the processing chamber comprises a length and the coalescing element extends across the length of the processing chamber.

43. The processor of claim 27, comprising:

an outlet valve fluidly connected to the oil outlet hose;

an inlet valve fluidly connected to the oil inlet hose;

an oil pump fluidly connected to the oil outlet hose; and a relief valve fluidly connected to the oil outlet hose.

44. The processor of claim 43, wherein the oil outlet is attached to the housing, the oil inlet hose is attached to the housing, and wherein the housing is mounted in a gantry.

45. The processor of claim 43, wherein the relief valve comprises an in port, an out port, and a relief port, and wherein the processor comprises a relief hose fluidly connecting the relief port to the oil inlet hose.

46. The processor of claim 45, wherein the oil pump is downstream of the outlet valve and the relief valve is downstream of the oil pump.

47. The processor of claim 46, comprising a pressure gauge connected to the oil outlet hose downstream of the relief valve.

48. An x-ray tube processing kit for processing oil in an x-ray tube housing, wherein the housing is mounted on a gantry, the kit comprising:

a processing chamber containing a coalescing filter;

a plurality of fluid hoses adapted to connect to the processing chamber;

an oil pump adapted to connect to one of the plurality of fluid hoses; and a vacuum pump adapted to connect to the processing chamber.

49. The kit of claim 48, comprising a plurality of quick-connectors.

50. The kit of claim 48, comprising a quick connector kit for positioning a quick-connector in-line between the housing and a heat exchanger, wherein the heat exchanger is mounted on the gantry, and wherein the oil is adapted to circulate through the heat exchanger and the housing.

51. The kit of claim 48, comprising a relief valve.

52. The kit of claim 48, comprising a carrying case for transporting the processing chamber.

53. The kit of claim 52, wherein the carrying case, the oil pump, the vacuum pump, and the processing chamber are sized such that the processing chamber, the vacuum pump, and the oil pump simultaneously fit in the carrying case.

54. The kit of claim 48, wherein the plurality of fluid hoses comprises at least two hoses fluidly connected to valves, including the one hose adapted to connect to the oil pump.

55. A method of improving insulating qualities of an insulating fluid in a housing comprising:

removing the insulating fluid from the housing;

passing the insulating fluid through a processing chamber to remove aromatic hydrocarbons, whereby the insulating qualities of the insulating fluid are improved, and returning the insulating fluid to the housing after aromatic hydrocarbons have been removed.

56. A method of conditioning insulating oil to be circulated in a housing comprising:

radiation-hardening the oil by exposing the oil to radiation to form water molecules by chemical disassociation; and removing water from the oil; and after removing water from the oil, introducing the oil the housing.

57. The method of claim 56, wherein the housing is a cooling chamber of a nuclear power plant, and the step of hardening comprises in a treatment chamber, exposing the oil to a radiation source, wherein the treatment chamber is separate from the cooling chamber.

58. The method of claim 56, wherein the housing is a housing for a radiation tube and the oil is radiation-hardened in the housing to tune the oil to the housing.

59. The method of claim 58, comprising mounting the housing on a gantry after radiation-hardening the oil.

60. A method of processing oil circulated through a housing for a radiation tube, the method comprising:

processing the oil in a processing chamber connected to the housing;

evacuating the processing chamber to remove gases from the oil to a desired level;

determining the desired level, including capturing the gases removed from the oil in a balloon trap; and halting processing upon reaching the desired level of removed gas.

61. A method of conditioning insulating oil to be circulated in a housing adapted to house a radiation tube for use in producing images, the method comprising:

placing the oil in the housing;

exposing the oil in the housing to a radiation source to tune the oil to the housing, wherein the radiation source is not the radiation tube used in producing images.

62. A method of extending the life of an X-ray tube having a housing, an insert located therein for producing X-rays, and insulating oil in the housing, the method comprising:

removing insulating oil from the housing;

passing the insulating oil through a processor wherein deleterious gases in the oil are removed; and returning the processed oil to the housing.

63. The method of claim 62, comprising removing water from the oil as a gas, wherein oil is dryer after processing than before processing.

64. The method of claim 63, comprising:

returning the dryer oil to the housing, wherein the dryer oil absorbs free water in the housing; and removing the absorbed water with the oil, whereby the housing is dryer than prior to absorption of the free water.

65. The method of claim 64, comprising repeating the following until a desired level of dryness in the housing is achieved:

returning dryer oil to the housing, wherein the dryer oil absorbs free water in the housing; and removing the absorbed water with the oil.

66. The method of claim 62, comprising maintaining the housing on a gantry.

67. The method of claim 62, comprising circulating the processed oil through the housing and the processor, whereby water is removed from the oil as a gas each time the oil passes through the processor until a desired level of dryness is achieved.

68. A method of extending the life of an X-ray tube having a housing, an insert located therein for producing X-rays, and insulating oil in the housing, the method comprising:

removing insulating oil from the housing;

passing the insulating oil through a processor wherein deleterious gases in the oil are removed;

returning the processed oil to the housing;

circulating the processed oil through the housing and the processor, whereby water is removed from the oil as a gas each time the oil passes through the processor until a desired level of dryness is achieved; and mixing the processed oil with sump oil in the processor prior to returning the oil to the housing.

69. A method of extending the life of a radiation tube positioned on a gantry and having a housing, an insert located in the housing for producing radiation, the method comprising:

passing the insulating oil through a processor while maintaining the radiation tube on the gantry;

removing water from the oil as a gas; and removing the gas from the housing.

70. The method of claim 68, comprising removing the oil from the housing prior to passing the oil through the processor whereby the water is removed from the oil after the oil has been removed from the housing.

71. The method of claim 70, comprising repeating the foregoing to achieve a desired level of dryness in the oil.

72. The method of claim 70, comprising mixing the oil with sump oil in the processor prior to returning the oil to the housing.

73. A method of extending the life of a radiation tube having a housing, an insert in the housing for producing radiation, and insulating oil in the housing, the method comprising:

processing the insulating oil to remove water from the oil; and achieving a water-to-oil level of approximately 20 parts of water per million parts of oil.

74. The method of claim 73, comprising maintaining the housing on a gantry.

75. A method of extending the life of a radiation tube having a housing with an insert for producing radiation located in the housing and insulating oil in the housing, the method comprising:

removing the insulating oil from the housing;

exposing the insulating oil to a chamber having a reduced pressure;

removing water from the oil in the chamber; and returning the oil to the housing.

76. The method of claim 75, wherein the reduced pressure is less than approximately 700 microns.

77. The method of claim 75, comprising increasing the pressure in the housing relative to an operating pressure in the housing.

78. The method of claim 77, increasing the pressure in the housing until at least one gas bubble returns to solution.

79. A method of extending the life of a radiation tube having a housing with an insert for producing radiation located in the housing and insulating oil in the housing, the method comprising:

removing the insulating oil from the housing;

exposing the insulating oil to a chamber having a reduced pressure;

removing water from the oil in the chamber;

returning the oil to the housing; and mixing the oil with the sump oil in the chamber prior to returning the oil to the housing.

* * * * *

UNITED STATES PATENT AND TRADEMARK OFFICE

CERTIFICATE OF CORRECTION

PATENT NO. : 6,254,272 B1
DATED : July 3, 2001
INVENTOR(S) : Maurice D. Dilick

It is certified that error appears in the above-identified patent and that said Letters Patent is hereby corrected as shown below:

Column 3,
Line 50, after "shows" delete [an] and insert -- a plan --

Column 5,
Line 42, "12–20" should be -- 12-20 --

Column 8,
Line 23, after "Ritchie" insert -- . -- and new paragraph begins

Column 9,
Line 62, "15" is not bold
Line 66, "xray" should be -- x-ray --

Signed and Sealed this

First Day of January, 2002

*Attest:*

*Attesting Officer*

JAMES E. ROGAN
*Director of the United States Patent and Trademark Office*